US006921305B2

(12) United States Patent
Provost

(10) Patent No.: US 6,921,305 B2
(45) Date of Patent: Jul. 26, 2005

(54) OUTBOARD MOTOR

(76) Inventor: Brian Provost, 9104 Choupique Rd., Loreauville, LA (US) 70552

( * ) Notice: Subject to any disclaimer, the term of this patent is extended or adjusted under 35 U.S.C. 154(b) by 17 days.

(21) Appl. No.: 10/389,157

(22) Filed: Mar. 14, 2003

(65) Prior Publication Data

US 2004/0180588 A1 Sep. 16, 2004

(51) Int. Cl.[7] ..... B63H 20/32
(52) U.S. Cl. ..... 440/76; 440/49
(58) Field of Search ..... 440/49, 66, 76, 440/75, 59, 63

(56) References Cited

U.S. PATENT DOCUMENTS 2,096,457 A 3/1937 Irgens
3,628,492 A * 12/1971 Baldwin et al. ..... 440/75
4,826,459 A * 5/1989 Slattery ..... 440/55

* cited by examiner

*Primary Examiner*—Jesus D. Sotelo
(74) *Attorney, Agent, or Firm*—Keaty Professional Law Corporation

(57) ABSTRACT

An outboard drive unit for a watercraft to allow propulsion of the watercraft in mud and water. The drive unit has a reduction gear assembly mounted between a motor and a propeller assembly, thereby allowing an engine of given capacity to turn a propeller with increase pitch and surface plane area. A propeller shaft is oriented at an obtuse angle in relation to an input shaft extending from the motor to allow the watercraft to accelerate easier, especially in mud conditions, while protecting the propeller from impact with grass and under water obstructions.

2 Claims, 4 Drawing Sheets

OUTBOARD MOTOR

BACKGROUND OF THE INVENTION

This invention relates to outboard drive units and, more particularly, to a drive unit for use with a watercraft, such as a pleasure boat.

Conventional marine outboard drive units are supported on a transom of a boat and can be tilted about a horizontal tilt axis. When required for storage, servicing or repair, the drive units are tilted upward to raise the units above the water surface. There is no intermediate tilting position during operation of a watercraft; conventional outboard motors are submerged during operation below the water surface.

The majority of outboard motors are equipped to run in the water. A special category of outboard motors is designed to run in muddy waterways, in shallow water and in the body of water that has overgrown with vegetation. In such cases, the conventional outboard drive unit becomes almost useless, especially if vegetation wraps around the rotating portion of the propeller shaft or when the propeller shaft encounters particularly viscous or hard obstacles. There also exists a possibility of the propeller striking an underwater tree stump with a disastrous result.

The special category of mud propellers utilizes what is known as a "go-devil"—a special extended rod with a wide steering radius of up to 72 inches that helps raise the propeller out water or move it sideways in case of heavy obstructions. However, these types of drive units are difficult to operate and require special skill.

The present invention contemplates elimination of drawbacks associated with the prior art and provision of an outboard drive unit that can be tilted to extend partially above water and that would allow the watercraft to move safely in clear water as well as mud, while protecting the propeller unit.

SUMMARY OF THE INVENTION

It is, therefore, an object of the present invention to provide an outboard drive unit that can be used on a conventional water craft, such as a pleasure boat, for operation in clean water as well as mud conditions.

It is another object of the present invention to provide an outboard drive unit that allows tilting of the propeller unit to partially raise the propeller blade above the water.

It is a further object of the present invention to provide an outboard drive unit with a propeller having high pitch as compared to conventional propeller units to facilitate trimming of the boat in muddy waters.

It is still a further object of the present invention to provide an outboard drive unit that has a small steering radius to facilitate control of the boat.

These and other objects of the present invention are achieved through a provision of an outboard drive unit for a watercraft that has an upper unit housing an engine, or motor and a lower unit carrying a propeller assembly. Interposed between the engine and the propeller assembly is an input shaft, which engages a gear assembly.

The gear assembly is also operationally connected to the propeller assembly; the gear assembly is a reduction gear assembly with a reduction ratio is in the order of 1.5:1, as compared to conventional mud motors having a 1:1 gear ratio. The reduction gear allows a propeller with a greater pitch to be rotated using the same torque value generated by the engine.

The outboard drive unit can be tilted to control the level of submerging of the propeller assembly in water or mud. Normally, the propeller assembly is submerged when the watercraft is stationary. During acceleration, especially in mud, the propeller encounters significant resistance from the liquid medium. By tilting the drive unit and partially elevating the propeller assembly above water, an operator can use a larger propeller with the same engine power. This design also allows to reduce the drag forces acting on the propeller, thereby increasing speed and efficiency.

The outboard drive unit of the instant invention has the propeller shaft oriented at an obtuse angle in relation to the input shaft. This design allows to avoid damage to the propeller when encountering grass or underwater tree stumps. The drive unit has a steering radius of less than 20", more precisely about 16", which is a significant improvement in maneuverability as compared to conventional "go devil" designs.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
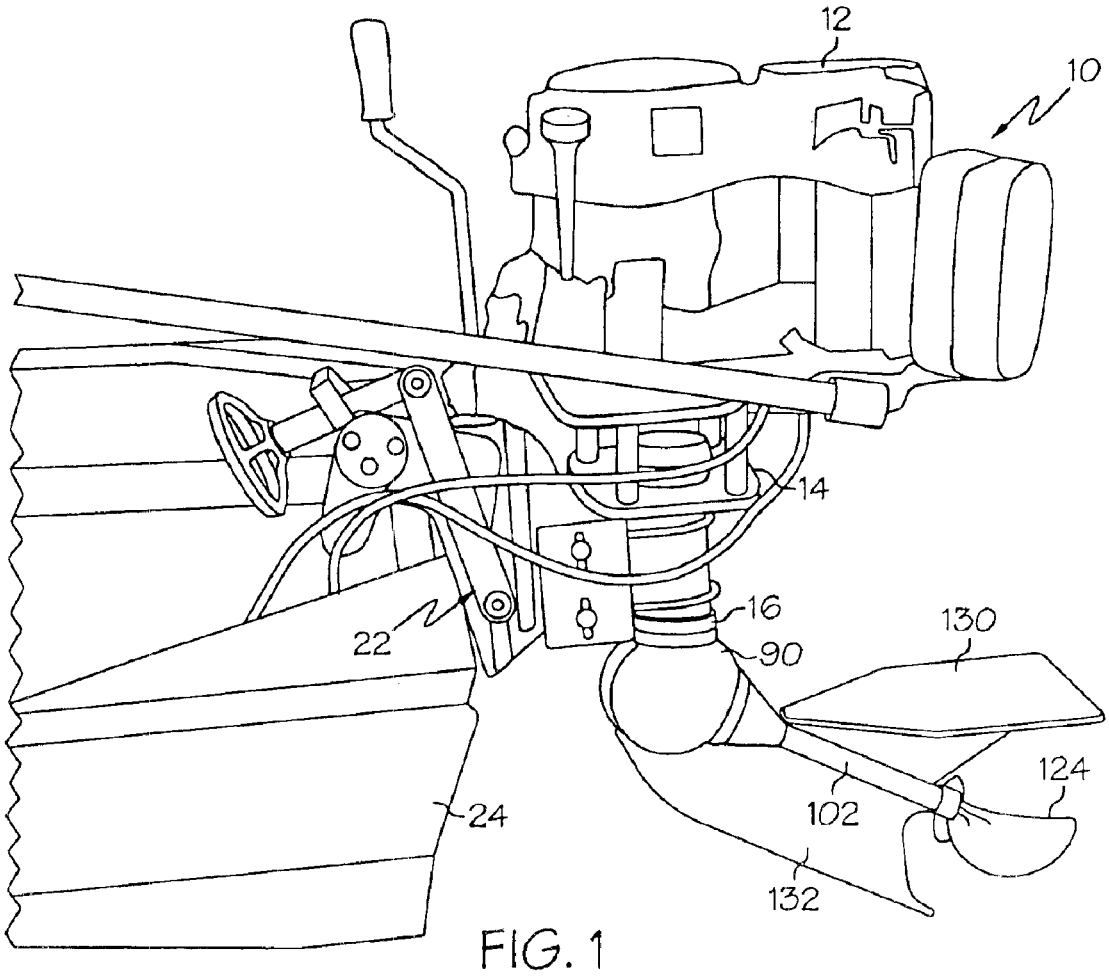
FIG. 1 is a perspective view of the outboard drive unit of the present invention as mounted on a boat.

Turning now to the drawings in more detail, numeral 10 designates the outboard drive unit of the present invention. The outboard motor 10 comprises an upper unit, or power head 12, a drive shaft housing 14 and a lower unit 16. The power head 12 includes an internal combustion engine (not shown) of a conventional design, for instance and inline two-cylinder motor that operates on a four-stroke combustion principle.

Similarly to conventional engines, the engine employed in the design of the present invention has reciprocating cylinders moving within combustion chambers and moving a crank shaft or drive shaft. The drive shaft transmits rotational force to the lower unit 16 through an input shaft 20.

The engine 12 is connected to a fuel supply system (not shown) that supplies a fuel charge to the combustion chambers to allowing damning of the fuel an exhaust of gases out of the combustion chambers. Although not shown, it is within the knowledge of those skilled in the art that the engine 12 is also connected to lubrication and cooling systems that are conventionally employed for operation of such type of motors.

The lower unit 16 comprises a support assembly 22 which supports the drive unit 10 on the water craft transom 24. The support assembly 22 orients the lower unit along with the associated propeller assembly such that the propeller is submerged when the hull of the water craft is stationary on a body of water.

Figure 2:
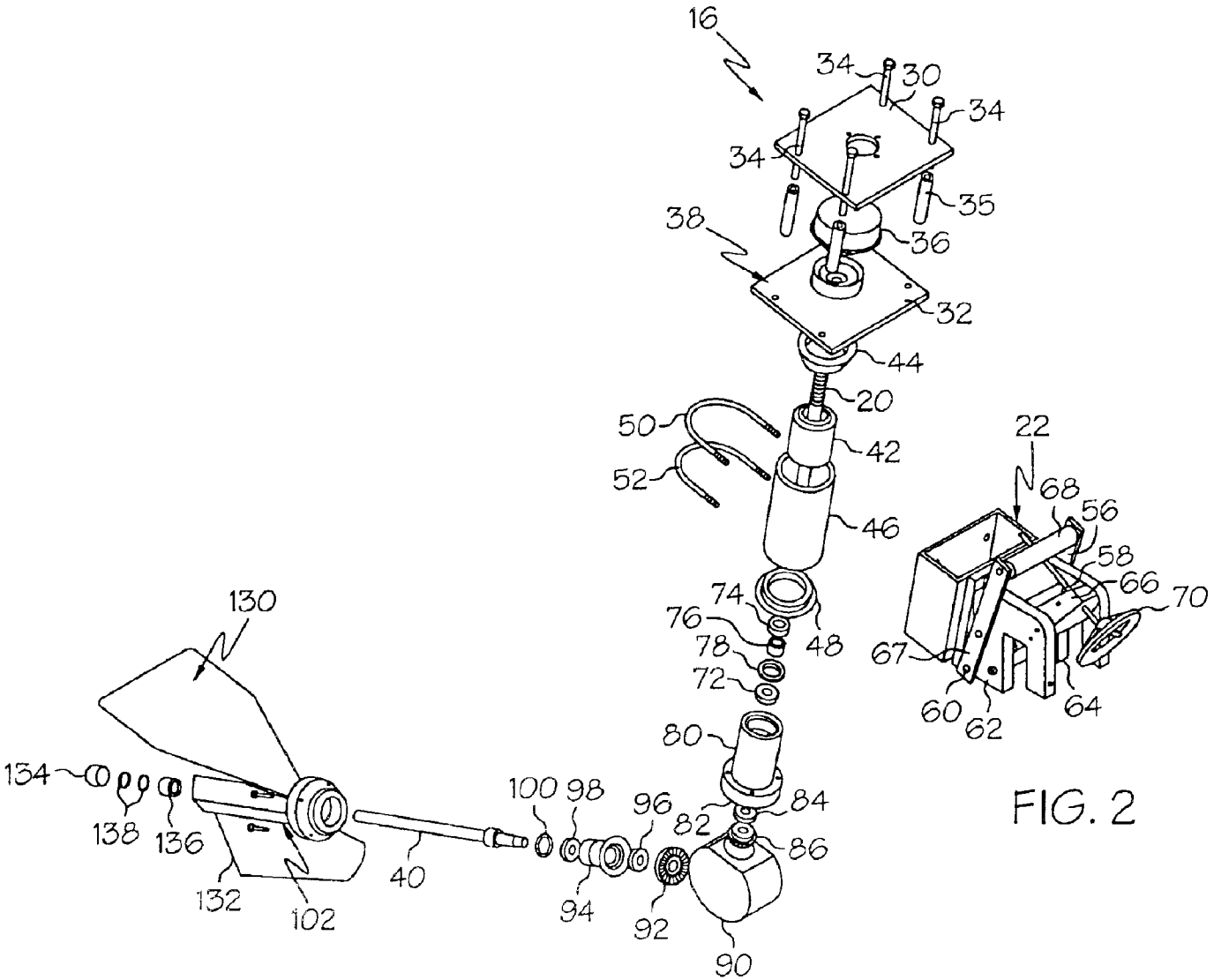
FIG. 2 is an exploded view of the steering and propeller portion of the outboard motor of the present invention.
Figure 3:
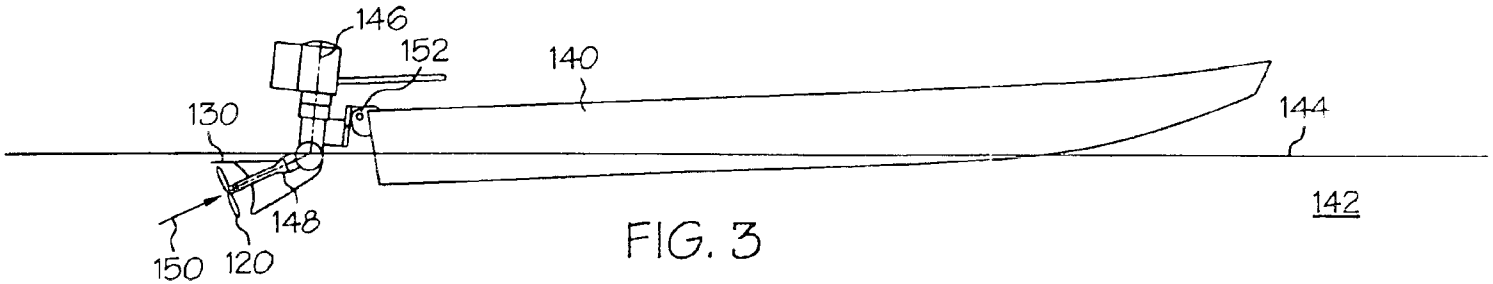
FIG. 3 is a schematic view of the outboard drive unit of the present invention in a position stationary in water.

Turning now in more detail to FIG. 2, the lower unit 16 is illustrated in an exploded view. As can be seen in the drawing, the lower unit is secured to the engine portion 12 with a pair of attachment plates 30, 32 using conventional bolts or other securing means 34. Each bolt 34 is received in a retainer 35 that help in retaining the plates 30, 32 in a parallel spaced-apart relationship to each other.

Mounted between the attachment plates 30, 32 is an electric clutch 36 resting on a drive coupling 38. The plates 30 and 32, as well as the coupling 38 are provided with central through openings allowing extension of a drive shaft connection therethrough. The input shaft 20 is connected to the drive shaft of the engine 12 for transmitting rotational force to a propeller shaft 40.

The upper portion of the input shaft 20 is enclosed in a standoff tube 42 mounted below the lower attachment plate 32. An upper steering bearing 44 is interposed between the stand off tube 42 and the plate 32. A steering tube 46 houses the standoff tube 42. A lower steering bearing 48 abuts the bottom of the standoff tube 46. A pair of U-shaped brackets 50, 52 extend about the outer circumference of the steering tube 46 for engagement with the support assembly 22. The brackets 50,52 can be secured with a pair of wing nuts (shown in FIG. 1) to the attachment bracket 54 of the support assembly 22.

The support assembly 22 also comprises a swivel bracket 56 provided with a pair of levers 67 and a swivel bracket cross bar 68. An internally threaded opening is formed in the cross bar 68 for receiving a distant end of a steering shaft 58 therethrough. A pair of tilt pins 60 (only one is shown in FIG. 2) secures the swivel bracket 56 to a support bracket 62. A clamp 64 with an internally threaded opening receives a proximate end of the threaded steering shaft 58. A hand wheel 70 is secured on the proximate end of the steering shaft 58 to facilitate tilting of the drive unit, as will be explained in more detail hereinafter.

The support bracket 62 is fitted between the levers 67 and receives the tilt pins 60. The clamp 64 is secured between the arms of the support bracket 62 and is attached to the support bracket cross bar 66, as can be better seen in FIG. 2.

Secured below the lower steering bearing 48 is an upper thrust bearing 72 that is fitted, with a jam nut 74, a spacer 76 and an upper seal 78, into an input housing 80. The input housing 80 also houses a distant end of the input shaft 20. An annular flange 82 formed in the lower portion of the input housing 80 engages with a lower steering bearing 48 when the lower unit 16 is assembled.

Mounted below the upper thrust bearing 72 is an output thrust bearing 84 which is mounted, together with an input gear 86 in a hub 90. The input gear 86 is sized and shaped to mesh with an output gear 92 and provide a gear reduction in the ratio of 1.5:1 between the input shaft 20 and the propeller shaft 40. A bearings cartridge 94 houses a proximate end of the propeller shaft 40 along with a forward thrust bearing 96 and a rear thrust bearing 98. An internal seal, such as an O-ring 100 may be seated around the propeller shaft 40 at the point of engagement with the rear thrust bearing 98.

A distant end of the propeller shaft 40 is secured in a stuffing tube 102 that carries a skeg 132 and a cavitation plate 130. The cavitation plate 130 is oriented at about a right angle in relation to the skeg 132. A propeller 120 is secured for rotation on the propeller shaft 40 and an end cap 134 is fitted on the distant end of the propeller shaft 40. The design of the propeller assembly may also include a needle roller bearing 136 mounted between the end cap 134 and the stuffing tube 102. A pair of lower seals 138 protects the needle roller bearing 136 during rotation of the shaft 40.

Figure 9:
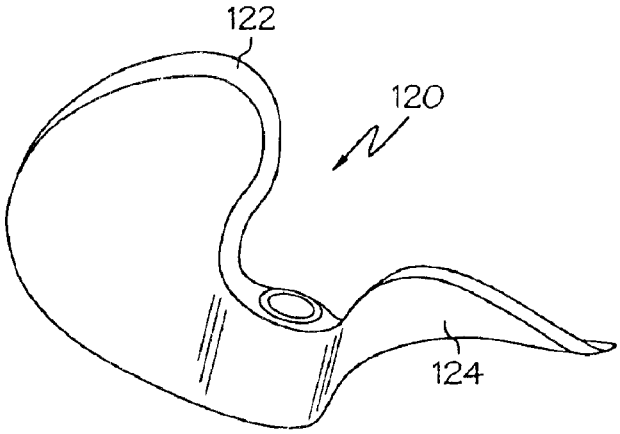
FIG. 9 is a perspective view of a propeller blade of the outboard drive unit of the present invention.

The design of the propeller 120 can be better seen in FIG. 9. As shown in the drawing, the propeller 120 has a cupped area 122 and an auger portion 124. The cupped area occupies about 110 degrees of an arcuate portion of the propeller blade. The cupped area 122 ends approximately at a point where the propeller effective blade area culminates. The angle of the cup of the propeller is about 25 degrees with a pitch of about 13 inches. Of course, these dimensions are exemplary and can be modified, depending on the torque demands of the drive unit. In the embodiment shown in FIG. 9, rotation of the propeller 120 covers a distance of approximately 15 inches.

Turning now to the mode of operation of the drive unit of the present invention, with reference to FIGS. 3–8, the watercraft 140 is shown floating in a stationary position in a body of water 142. The propeller 120 and the cavtitation plate 130 are below the surface 144 of the water body 142. As can be seen in the drawings, an axis 146 of the drive shaft is oriented at an obtuse angle to an axis 148 of the propeller shaft 40. This arrangement is different from conventional outboard motors, where the drive shaft and the propeller shaft are arranged in a co-axial relationship.

When the propeller shaft 40 along with the propeller 120 is oriented to extend below the bottom of the watercraft 140, there is a possibility of grass and other vegetation getting caught on the lower unit and cause cooling water suction that may plug and block water in the propeller. Underwater stumps present additional danger. The impact directly with the front of the lower unit causes the motor to "kick up" very hard. The traditional "go-devil" unit operating in muddy conditions is imperfect as it causes the propeller to pop out of water every time the propeller encounters mud or grass. The pivot point allows the propeller shaft to be raised while the cavitation plate remains under water in such a design. However, the shaft of the propeller tends to be pushed above the pivot point, rendering propulsion of the boat very difficult.

Figure 8:
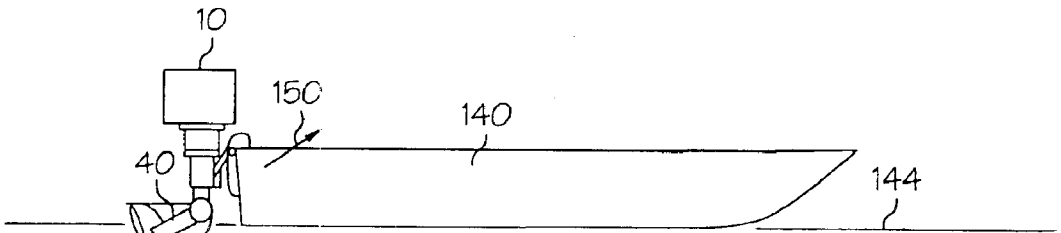
FIG. 8 is a schematic top view of a watercraft with an outboard drive unit of the present invention illustrating steering radius from at the steering pivot point and propeller.

The design of the present invention utilizing the obtuse angle orientation between the axis of the propeller shaft and the input shaft minimizes or altogether eliminates this problem. The direction of the thrust force designated by numeral 150 keeps the propeller below the pivot point 152 both when the boat is stationary (FIG. 3) and when the propeller shaft is raised to avoid contact with underwater obstacles (FIG. 8).

Figure 4:
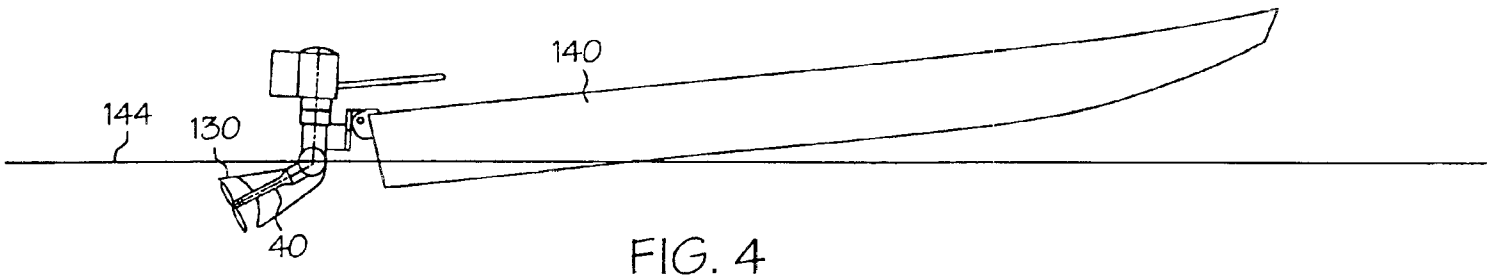
FIG. 4 is a schematic view showing the boat as it accelerates in water, with a cavitation plate of the propeller unit being completely submerged under water.

FIG. 4 illustrates position of the boat and the drive unit 10 in water as the water craft 140 begins its acceleration. As can be seen in the drawing, here the cavitaiton plate is lowered under water, with the drive unit pivoting about the pivot point 152 to lower the propeller shaft 40 deeper into the water. The cavitation plate 130 acts as a "ski" adding length to the planing surface and facilitating propulsion of the boat 140.

Figure 5:
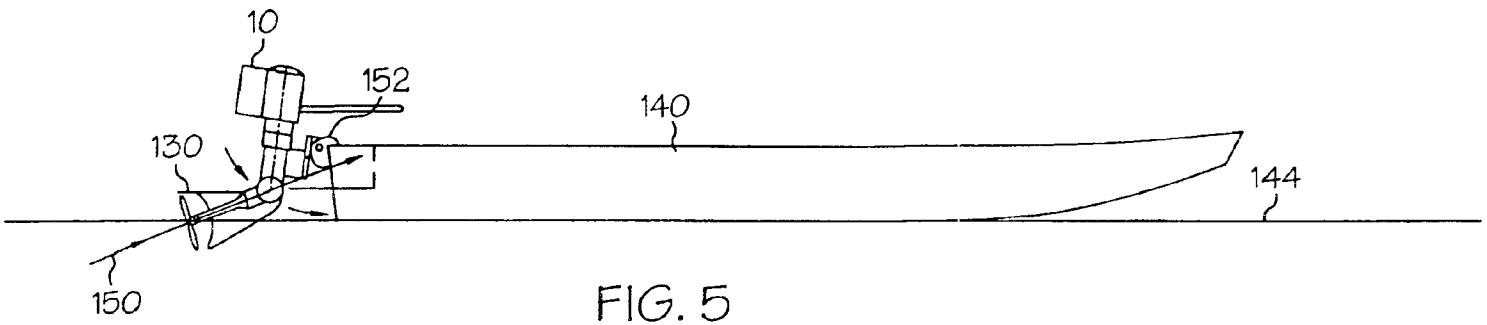
FIG. 5 is a schematic view illustrating the water craft with an outboard drive unit of the present invention when the boat is completely on plane in either mud or water.

FIG. 5 schematically illustrates position of the boat 140 when it navigates in mud or water. The propeller 120 partially extends above water and the cavitation plate 130 is exposed above the water surface 144. The direction of the thrust force 150 is directed along the line of the propeller shaft towards the boat transom.

The drive unit 10 turns about the pivot point 152 by the boatman turning the wheel 70 of the attachment unit 22. The operator can easily change the relative orientation of the steering shaft by turning the wheel 70 clockwise or counter-clockwise. By turning the wheel 70, the operator causes the drive unit to change its relative position to the surface 144, helping the unit to move through water or mud.

With the propeller partially out of the water, a larger propeller can be turned with the same engine having a pre-determined power capacity. This also means less drag in the water since a smaller portion of the lower unit is submerged. As a result the same power motor can achieve more speed and efficiency using the lower unit of the design of the present invention.

Figure 6:
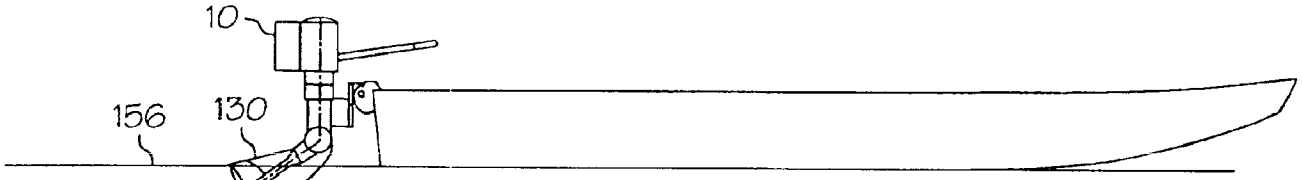
FIG. 6 is a schematic view illustrating position of the boat and the outboard drive unit of the present invention when the boat accelerates on mud.

The present invention is particularly advantageous when the boat needs to accelerate in shallow, muddy water full of vegetation, grass, etc. Position of the propeller in such cases can be seen in FIG. 6. When the boat is taking off in muddy conditions, the propeller 120 is dropped below a mud line 156. A larger propeller, with low pitch can be used thanks to the reduction gear assembly forming part of the lower unit. The larger propeller can "grab" better than a smaller propeller with conventional 1:1 gear ratio. In the position of the boat 140 as illustrated in FIG. 6, the cavitation plate 130 is above water, while the boat 140 accelerates in mud. After the boat takes off, the engine is trimmed to the running position, with the propeller working under normal torque conditions.

Figure 7:
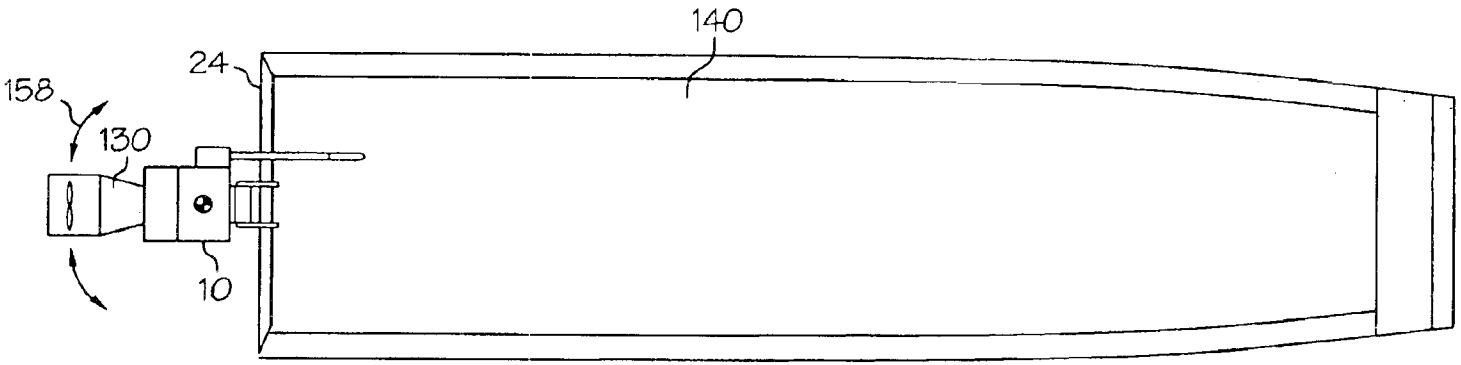
FIG. 7 is a schematic top view of a water craft with an outboard drive unit of the present invention illustrating steering radius from at the steering pivot point and propeller.

FIG. 7 shows the turning or steering radius from a steering pivot point provided by the design of the present invention The steering radius designated by numeral 158 in FIG. 7 is less than 20 inches, preferably about 16 inches. Conventional long shaft mud motors have radius of about 72 inches, making them much more difficult to turn and navigate in muddy conditions.

FIG. 8 illustrates position of the water craft 140 while encountering grass 160 or an underwater tree stump 162. The operator, observing dangerous conditions, tilts the drive unit 10, partially lifting the propeller 120 out of water and above the water surface 144. The direction of the thrust force 150 continues to ensure that the boat 140 is propelled, while the propeller shaft 40 is partially lifted, protecting the propeller when it encounters the grassy area 160 or underwater tree stumps 162. The tilt angle will help deflect the outboard motor unit 10 off of the stump easier than conventional outboard motors.

During trim/tilt of the watercraft, the hand wheel 70 pulls on a thrust bearing. The threaded steering rod, or shaft 58 pulls the cross bar 68 moving the trim lever assembly with the levers 67. The trim levers 67 pivot on the pin 60 and tilt the drive unit 10. As the motor tilts, the propeller 120 is lifted.

Many modification and changes can be made in the design of the present invention without departing from the spirit thereof. I, therefore, pray that my rights to the present invention be limited only by the scope of the appended claims.

I claim:

1. An outboard drive unit for a watercraft, comprising:

an upper unit housing a motor with a drive shaft;

a lower unit operationally connected to the upper unit, the lower unit comprising an input shaft;

a propeller assembly comprising a propeller shaft, said propeller shaft being oriented at an obtuse angle in relation to said input shaft, a propeller blade mounted on the propeller shaft, a cavitation plate and a skeg mounted at a generally right angle to said cavitation plate, said propeller blade and said cavitation plate being normally submerged under the surface of mud or water when the watercraft is in a stationary position and at least partially above the mud or water surface when the watercraft moves on plane on mud or water surface, said cavitation plate and said skeg are secured on a stuffing tube, and wherein the propeller shaft extends through said stuffing tube, a distant end of the propeller shaft carrying the propeller blade, and wherein the cavitation plate extends above the propeller blade, said propeller blade having a certain arcuate portion, a cupped area and an auger portion, said cupped area occupying about 110 degrees of the arcuate portion of the propeller blade; and a means for adjusting trim of the propeller assembly, thereby allowing extension of a propeller blade partially above a water line when the watercraft moves on plane on mud or water surface, and a reduction gear assembly mounted between and operationally connected to said input shaft and said propeller assembly.

2. An outboard drive unit for a watercraft, comprising:

an upper unit housing a motor with a drive shaft;

a lower unit operationally connected to the drive shaft of the upper unit, the lower unit comprising an input shaft, a propeller assembly and a reduction gear assembly mounted between and operationally connected to said input shaft and said propeller assembly, said reduction gear assembly having a reduction ratio of 1.5:1 to thereby facilitate a propeller unit having an increased pitch to be rotated by the motor, and wherein the propeller assembly is oriented at an obtuse angle in relation to input shaft, said propeller unit being adapted to be tilted to allow a propeller blade to partially extend above a water line when the watercraft moves on plane on mud or water surface, propeller blade having a pre-determined arcuate portion, a cupped area and an auger portion, said cupped area occupying about 110 degrees of the arcuate portion of the propeller blade.

* * * * *